United States Patent [19]

Barnhard, IV et al.

[11] 4,394,199

[45] Jul. 19, 1983

[54] EXPLOSIVE EMULSION COMPOSITION

[75] Inventors: Philip Barnhard, IV, Spanish Fork; Lyman G. Bahr, Payson, both of Utah

[73] Assignee: Agnus Chemical Company, Northbrook, Ill.

[21] Appl. No.: 299,742

[22] Filed: Sep. 8, 1981

[51] Int. Cl.[3] ..... C06B 45/02

[52] U.S. Cl. ..... 149/21; 149/2; 149/47; 149/62; 149/89

[58] Field of Search ..... 149/2, 21, 47, 62, 89

[56] References Cited

U.S. PATENT DOCUMENTS

| | | | |
|---|---|---|---|
| 3,161,551 | 12/1964 | Egly et al. | 149/46 |
| 3,338,165 | 8/1967 | Minnick | 102/27 |
| 3,419,444 | 12/1968 | Minnick | 149/2 |
| 3,985,593 | 10/1976 | Machacek | 149/89 |
| 4,008,110 | 2/1977 | Machecek | 149/89 |
| 4,097,316 | 6/1978 | Mullay | 149/89 |
| 4,111,727 | 9/1978 | Clay | 149/2 |
| 4,175,990 | 11/1979 | Hattori et al. | 149/89 |
| 4,326,900 | 4/1982 | Hattori et al. | 149/89 |

*Primary Examiner*—Stephen J. Lechert, Jr.

*Attorney, Agent, or Firm*—Leydig, Voit, Osann, Mayer & Holt, Ltd.

[57] ABSTRACT

An explosive, water-in-oil type emulsion composition comprising an aqueous phase of from 70–90% by weight comprising water 10–30%, oxidizing salt 50–75%, an oil phase 5–20%, an air entrapping material 1–5% and an emulsifying agent 1–5%. Nitropropanes constitute all or a portion of the fuel component.

9 Claims, No Drawings

EXPLOSIVE EMULSION COMPOSITION

BACKGROUND OF THE INVENTION

This invention relates to an explosive emulsion composition. In a particular aspect, this invention relates to an explosive emulsion composition containing a nitroalkane.

Water-in-oil type of emulsions are very useful blasting agents in the explosives art because such emulsions have considerable water resistance. They can, therefore, be used in wet holes where oil-in-water or ANFO type blasting agents would be unsuitable. Also, they offer the advantages of safety and low material cost when compared to conventional high explosives, especially those containing metal particulates as sensitizers.

Although nitromethane is well-known in the explosives art, higher nitroalkanes, especially the nitropropanes, have received considerably less attention. However, it is known from Egly et al, U.S. Pat. No. 3,161,551 to provide water-in-oil emulsions utilizing nitroalkanes. These emulsions were said to be suitable for use in the preparation of blasting agents. Suitable emulsifiers included oxazolines, fatty acid salts of alkaline earth metals, polyoxyethylene derivatives of sorbitol esters and of fatty acids. The emulsions contained 50–70% ammonium nitrate, 15–35% water and 5–20% of an organic liquid including fuel oils and nitroalkanes. The emulsions were then mixed with additional ammonium nitrate to produce the blasting agent. However, according to R. B. Clay, U.S. Pat. No. 4,111,727, compositions of this type were found not to be reliably detonable without being gassed or aerated. Minnick, in U.S. Pat. No. 3,338,165, taught the preparation of gels using, among other ingredients, nitromethane and air-entrapping materials and in U.S. Pat. No. 3,419,444 taught the preparation of aqueous slurries in which gelled nitroalkanes were dispersed. Other workers have disclosed water-in-oil type emulsions useful as explosives, but none of them taught nitropropane-containing emulsions.

There is, therefore, a need for water-in-oil type of blasting agents wherein the nitropropanes can be used as a portion of the fuel.

SUMMARY OF THE INVENTION

It is an object of this invention to provide an explosive emulsion composition.

It is another object of this invention to provide an explosive emulsion composition containing a nitropropane.

Other objects of this invention will be apparent to those skilled in the art from the disclosure herein.

An explosive emulsion composition of the water-in-oil variety has been discovered wherein the water phase comprises about 70–90% by weight of the emulsion and oil phase comprises about 5 to about 20%. The water phase comprises an aqueous solution of oxidizing salts and the oil phase comprises the fuel portion. The composition also includes sufficient emulsifying agent to produce a suitable emulsion and one or more sensitizers.

DETAILED DISCUSSION

The composition of the present invention generally comprises an aqueous phase of from about 70–90% by weight, an oil phase of from about 5–20%, a thickener 0–4%, emulsifiers 1.0 to 8.0%, and one or more sensitizers 0.5–6%.

The composition is generally prepared by preparing the aqueous phase and the oil phase separately, then adding the aqueous phase slowly to the oil phase with a high degree of agitation, such as by means of a high sheer mixer. A sensitizer, such as an entrapped gas component, e.g., hollow microspheres (e.g. Microballoons) or perlite, is then added and well mixed.

The aqueous phase comprises an aqueous solution of an oxidizing salt, such as alkali and alkaline earth nitrates and perchlorates, ammonium perchlorate, ammonium nitrate, or mixtures thereof. Generally, the aqueous phase is comprised of about 5–35% water and 50–90% of oxidizing salt. Preferably, the oxidizing salt portion comprises 50–75% of the mixture with 50–75% water and consists of ammonium nitrate or a mixture of ammonium nitrate with up to about 20% sodium nitrate and/or calcium nitrate, preferably about 10% of sodium nitrate (based on the total emulsion). The ammonium nitrate is preferably supplied as the 83% aqueous solution, which is commercially available, and additional water is added as needed.

The oil phase, which comprises from 5–20% of the finished emulsion, supplies the fuel portion of the explosive. Suitable ingredients include coal, paraffin wax, fuel oil (e.g. No. 2 or No. 5) and nitropropane or mixtures thereof. Nitropropane, which can be 1- or 2-nitropropane, is a preferred fuel ingredient and is usually present, though not necessarily so, in an amount of from 1 to about 20% based on the finished emulsion. Nitropropanes are preferred because they produce better density, improved detonation rate and less negative oxygen balance. Coal, when used, is generally used along with paraffin and oil, e.g. No. 5 oil, in an amount of 1%. Paraffin, when used, is generally present in an amount up to about 6%. Fuel oil is used in an amount up to about 8%. Other fuel ingredients include other hydrocarbons, such as olefins, aromatics, alkanes in general, waxes in general, and fatty acid triglycerides.

If desirable, a thickener, up to about 4%, can be added to the fuel portion, especially with nitropropane. Any thickener useful in the explosives art can be used. Suitable thickeners include but are not limited to cellulose acetatebutyrate and polystyrene.

Any art-recognized water-in-oil emulsifying agent may be used in the practice of this invention including lecithin, fatty acid esters of polyoxyethylene alcohols or sorbitan, lignosulfonates, alkali metal soaps of fatty acids. Lecithin is a preferred emulsifying agent. It is used in the range of 0.1–15%, preferably 1–8%. The lecithin can be either the solid or liquid form including any of the water, acetone, or alcohol soluble forms. Suitable sources include commercial soybean lecithin. The unbleached liquid form is the most economical and hence is particularly preferred.

As is known in the art, emulsions must usually be sensitized to perform satisfactorily. Many such sensitizers are known and are useful in the practice of this invention. Such sensitizers include air-entrapping materials such as wood pulp, bagasse, celite, preferably aluminum flakes or hollow microspheres or perlite. The amount of sensitizer used is generally in the range of 0.5–6%, usually 2–4%, depending on the sensitivity of the formulation. Hollow microspheres are preferred.

The invention will be better understood with reference to the following examples. It is understood that these examples are intended only to illustrate the invention and it is not intended that it be limited thereby.

EXAMPLE 1-12

The following emulsions were prepared by art-recognized methods. They had good density and were all cap or booster sensitive. The rate of detonation in 2¼ inch diameter was above 5000 m/second. In the following examples, the booster, when used, was Pentolite.

| | EXAMPLE | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Aqueous Phase, % | 86.00 | 88.00 | 89.10 | 86.00 | 88.00 | 87.00 | 82.50 | 83.5 | 84.50 | 71.3 | 75.00 | 86.00 |
| Oxidizers, % | 71.38 | 73.04 | 73.95 | 71.38 | 73.04 | 72.21 | 68.48 | 72.4 | 54.97 | 52.58 | 51.67 | 60.95 |
| AN | 71.38 | 73.04 | 73.95 | 71.38 | 73.04 | 72.21 | 68.48 | 54.72 | 37.47 | 42.58 | 51.67 | 50.95 |
| $NaNO_3$ | — | — | — | — | — | — | — | 18.18 | — | 10.00 | — | 10.00 |
| $Ca(NO_3)_2$ | — | — | — | — | — | — | — | — | 17.50 | — | — | — |
| Water, % | 14.62 | 14.96 | 15.15 | 14.62 | 14.96 | 14.79 | 14.02 | 11.1 | 29.53 | 18.72 | 23.33 | 25.05 |
| Water, added | — | — | — | — | — | — | — | — | 14.36 | 10.00 | 12.75 | 14.62 |
| Water, from AN | 14.62 | 14.96 | 15.15 | 14.62 | 14.96 | 14.79 | 14.02 | 11.1 | 7.67 | 8.72 | 10.58 | 10.43 |
| Water, from Ca Nit | — | — | — | — | — | — | — | — | 7.5 | — | — | — |
| Oil Phase, % | 9.0 | 9.0 | 7.92 | 11.0 | 9.0 | 10.0 | 14.0 | 13.0 | 12.0 | 19.80 | 17.00 | 8.00 |
| Paraffin | 3.0 | 2.0 | — | — | 5.0 | 3.0 | 3.0 | 3.0 | 5.0 | — | 3.00 | 4.00 |
| Oil #2 | 3.0 | 3.0 | — | 1.0 | — | — | — | — | — | — | — | — |
| Oil #5 | 2.0 | 1.0 | — | — | 1.0 | 1.0 | 1.0 | — | — | — | — | — |
| Nitropropane | 1.0 | 3.0 | 7.92 | 10.0 | 3.0 | 6.0 | 10.0 | 10.0 | 7.00 | 19.80 | 14.00 | 4.00 |
| Lecithin, % | 1.0 | 1.0 | 1.0 | 1.0 | 1.0 | 1.0 | 1.5 | 1.5 | 1.5 | 2.00 | 5.00 | 4.00 |
| Microballoons, % | 4.0 | 2.0 | 1.98 | 2.0 | 2.0 | 2.0 | 2.0 | 2.0 | 2.0 | 3.00 | 2.0 | 2.0 |
| Total, % | 100 | 100 | 100 | 100 | 100 | 100 | 100 | 100 | 100 | 100 | 100 | 100 |
| PROPERTIES | | | | | | | | | | | | |
| Density | 1.14 | 1.27 | 1.27 | 1.27 | 1.20 | 1.20 | 1.21 | 1.28 | 1.27 | 1.22 | — | — |
| Sensitivity | 5 g | #16 cap | 3 g | 3 g | 3 g | 3 g | 5 g+ | 5 g+ | 10 g | #10 cap | 50 g | 50 g |
| Detonation rate, m/sec | | | | | | | | | | | | |
| 2" diameter* | 4174 | — | 5275 | — | — | — | — | — | — | 4857 | — | — |
| 1½" steel pipe | — | — | — | — | 5826 | 6094 | — | — | — | — | — | — |

*Unconfined

We claim:

1. A water-in-oil emulsion explosive composition consisting essentially of (a) an aqueous phase comprised of a solution of oxidizing salts, (b) an oil phase consisting essentially of a nitroparaffin having three carbon atoms and optionally a hydrocarbon, (c) an emulsifying agent, and (d) at least one sensitizing agent.

2. The composition of claim 1 wherein the aqueous phase contains 5-35% water and 50-90% oxidizing salt, based on the composition as a whole.

3. The composition of claim 2 wherein the oxidizing salt is ammonium nitrate or a mixture thereof with sodium nitrate or calcium nitrate.

4. The composition of claim 3 wherein the oxidizing salt is a mixture of ammonium nitrate 40-55% and sodium nitrate 10-18% based on the total weight of the mixture.

5. The composition of claim 1 wherein the oil phase consists essentially of, based on the weight of the final emulsion, a nitropropane from about 1.0 wt.% to about 20.0 wt.%, paraffin wax from about 0 wt.% to about 5 wt.%, and a liquid hydrocarbon from about 0 wt.% to about 3 wt.%.

6. The composition of claim 1 wherein the emulsifying agent is provided by lecithin 1.0-8.0%.

7. The composition of claim 1 wherein the sensitizing agent is provided by hollow microspheres, 0.5-6%.

8. A water-in-oil emulsion explosive composition consisting essentially of (a) from about 70 wt.% to about 90 wt.%, based on the weight of the final emulsion, aqueous phase comprised of a solution of oxidizing salts, (b) from about 5 wt.% to about 20 wt.% oil phase, said oil phase essentially free of gelatinizing agent, comprising from about 1 wt.% to about 20 wt.%, based on the weight of the final emulsion, of a nitroparaffin having three carbon atoms, (c) from about 1 wt.% to about 8 wt.% of an emulsifying agent and (d) from about 0.5 to about 6 wt.% sensitizing agent.

9. The composition of claim 1 wherein the oil phase consists essentially of, based on the weight of the final emulsion, from about 1.0 wt.% to about 20.0 wt.% of a nitropropane, from about 0 wt.% to about 5 wt.% paraffin wax, and from about 0 wt.% to about 3 wt.% of a liquid hydrocarbon.

* * * * *